United States Patent [19]

Julian et al.

[11] Patent Number: 5,009,141

[45] Date of Patent: Apr. 23, 1991

[54] BLADE ASSEMBLY FOR SLICING FOOD PRODUCTS

[75] Inventors: John C. Julian, Tualatin; David S. Phelps, Tigard, both of Oreg.

[73] Assignee: Lamb-Weston, Inc., Tri-Cities, Wash.

[21] Appl. No.: 779,209

[22] Filed: Sep. 23, 1985

[51] Int. Cl.[5] ..... B26D 1/02

[52] U.S. Cl. ..... 83/857; 83/402; 83/425.003; 83/932

[58] Field of Search ..... 83/27, 402, 858, 856, 83/857, 425.1; 426/518

[56] References Cited

U.S. PATENT DOCUMENTS

| | | | |
|---|---|---|---|
| 1,399,950 | 12/1921 | Fish | 83/857 X |
| 2,513,341 | 7/1950 | Marasco | 83/679 |
| 2,645,262 | 7/1953 | Marasco | 83/857 X |
| 2,852,053 | 9/1958 | Berry et al. | 83/857 X |
| 3,116,772 | 1/1964 | Lamb et al. | 83/27 |
| 3,391,005 | 7/1968 | Babigan . | |
| 4,082,024 | 4/1978 | Hodges et al. | 83/402 |
| 4,095,518 | 6/1978 | Jones | 83/857 X |
| 4,135,002 | 1/1979 | Hodges et al. | 426/482 |
| 4,300,429 | 11/1981 | Brown et al. | 83/857 X |
| 4,372,184 | 2/1983 | Fisher et al. | 83/857 X |

*Primary Examiner*—Douglas D. Watts
*Assistant Examiner*—Rinaldi Rada
*Attorney, Agent, or Firm*—Klarquist, Sparkman, Campbell, Leigh & Whinston

[57] ABSTRACT

An apparatus for slicing food products, including potatoes and the like, includes a plurality of perpendicularly intersecting knife blades of chevron configuration which are arranged in a substantially pyramidal formation. The apex of the pyramidal formation and apexes of the individual blades point downstream, away from the direction of flow of a fluid stream which carries the potatoes toward the knife assembly for slicing. The blades are mounted by a unitary fixture having a cylindrical bore and mounting the blades such that the farthest upstream blades are spaced farthest away from the axial center of the blade assembly, with successive downstream blades being spaced incrementally closer to such axial center. The blades are further mounted such that no parallel blades axially overlap one another.

11 Claims, 2 Drawing Sheets

FIG. 1
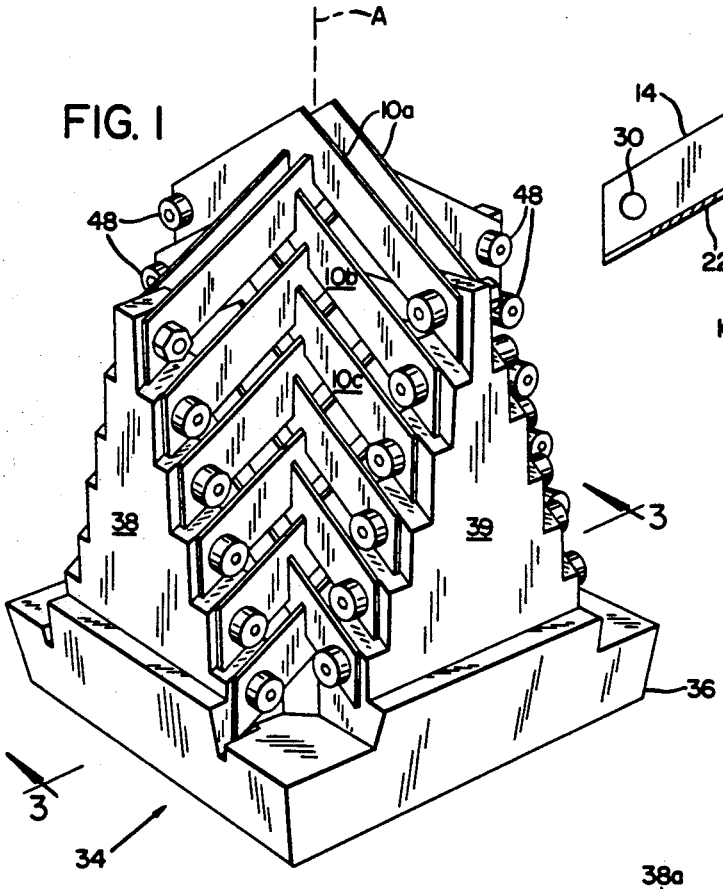
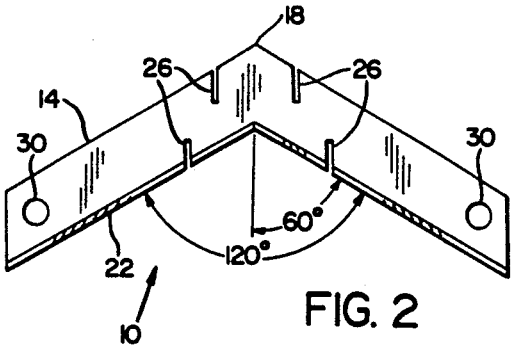
FIG. 2
FIG. 3
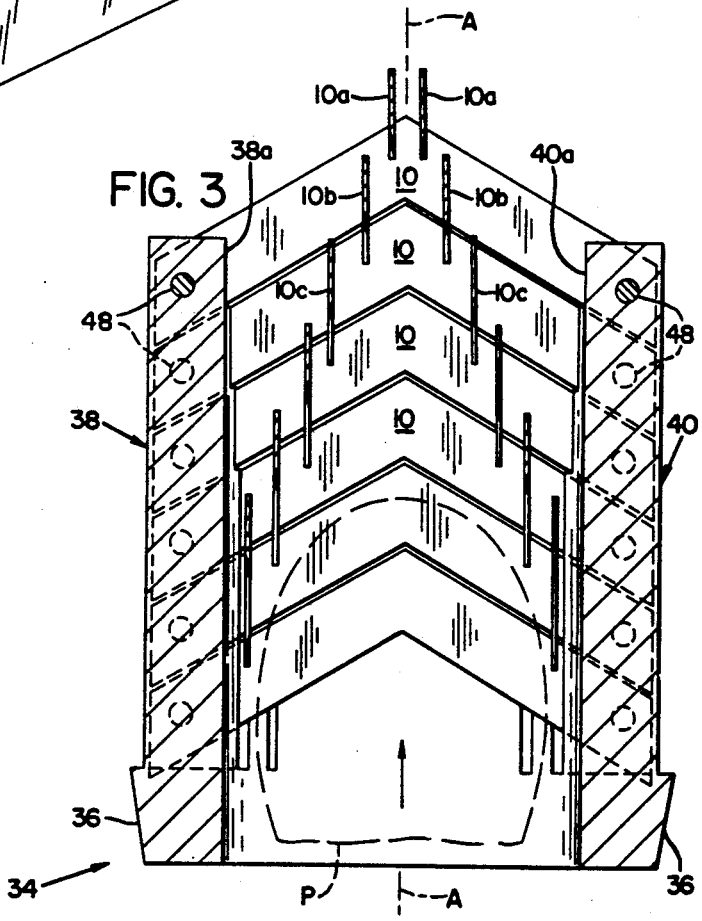
FIG. 6
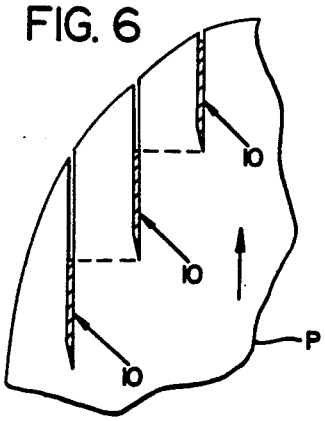

BLADE ASSEMBLY FOR SLICING FOOD PRODUCTS

BACKGROUND OF THE INVENTION

This invention relates generally to apparatus for slicing food products into strips, especially the slicing of potatoes into strips suitable for processing as "french fries".

Heretofore, various slicing apparatus have been used to slice potatoes into elongate strips suitable for processing as french fries. One such apparatus, sometimes referred to as a "box cutter", comprises a series of perpendicularly intersecting, straight-edged blades to form a grid of box like cutters. The grid is forced mechanically through the potato, which is held stationary, thereby slicing the potato into strips of square cross section. A relatively large force is required to force the grid through the potato. Also, as the blades slice through the potato, they cause small breaks and fractures in the cut potato surfaces, making the resulting strips more fragile during subsequent handling and processing. The damage to the potato surfaces during slicing is sometimes referred to as "feathering". Examples of box cutters are shown in Babigan U.S. Pat. No. 3,391,005 (FIGS. 11–15).

Another prior potato slicing apparatus is disclosed in Lamb et al., U.S. Pat. No. 3,116,772. In contrast to the box cutter just described, this patent discloses a system in which moving potatoes are forced through a stationary grid or matrix of sharpened blades. The potatoes are carried by conduit in a fast moving fluid stream and delivered individually and sequentially to the slicing apparatus which is aligned with the flow path of the potatoes. Each potato is forced through the slicing apparatus by the hydraulic flow and its own momentum, and is thereby cut into strips.

In one form FIGS. (2–6), the slicing apparatus includes a large box cutter for cutting away the outermost slabs of the potatoes and five crossed blades mounted within the box cutter downstream of its mouth. The five crossed blades are mounted in transversely spaced, axially staggered pairs, with the exception of one single, centrally located blade. As the potato is forced through the slicing apparatus, the outermost portions of the potato are progressively sliced away.

A second form of the slicing apparatus, shown in FIG. 18, is similar to the one just described, except that the blades are elongate and slotted to intersect one another and provide transverse support. As with the first form, both sets of parallel blades are axially staggered and arranged such that the outermost portions of the potato are progressively sliced away and eventually cut into strips.

Although both foregoing slicing apparatus work reasonably well, some binding of the potato occurs due to frictional engagement with the blades and "blade pinching". Blade pinching occurs when a sliced section of the potato is compressively forced between two blades. The tendency of the potato to bind is more acute with the blade assembly of FIG. 18, since it is designed to slice the potato into ¼ inch "shoe string" potato strips and hence has more blades (than the assembly of FIGS. 2–6) slicing through the potato.

Yet another potato slicing apparatus, intended to be an improvement of the one shown in U.S. Pat. No. 3,116,772, is disclosed in Hodges et al. U.S. Pat. No. 4,135,002. It has a plurality of intersecting, axially staggered blades of chevron configuration, which are arranged in a nested, pyramidal formation. The apex of the pyramidal formation and apexes of the blades themselves point in the direction of the approaching potato, which is carried in a fluid stream. This arrangement is intended to reduce binding by facilitating the use of thinner blades and permitting the incised potato portions to spread out upon slicing.

However, it is believed that some binding will still occur for two reasons. First, virtually all incised potato portions are frictionally engaged on opposite sides by adjacent, transversely spaced blades slicing through each potato portion. Second, such blades will exert a compressive force on the potato portion as it travels therebetween. Although each incised potato portion is permitted to spread somewhat during slicing to reduce binding, it is believed that thickness dimension of the blades will still cause some compression of the potato portion as it travels therebetween. Further, unless the potatoes are perfectly aligned with the apex of the blade arrangement, they will have a tendency to veer to one side upon striking the leading blades, or to turn or tumble slightly, thereby detracting from the quality of the cut. Ideally, the potatoes should remain aligned with and follow the axial centerline of the slicing apparatus to optimize cutting quality and effectiveness.

Accordingly, there remains a need for an improved blade assembly for slicing potatoes and the like into strips, which will minimize binding, reduce feathering, slice through the potato with minimal resistance, minimize the tendency of the potato to turn or tumble upon striking the blade assembly, and at the same time keep the potatoes axially aligned as they are sliced.

It is therefore one object of the present invention to provide an improved blade assembly for slicing potatoes and the like which improves the quality and effectiveness of the slicing operation.

Another object of the present invention is to provide a blade assembly as aforesaid which reduces feathering, thereby making the resulting cut strips less fragile and easier to handle and process further.

A further object of the present invention is to provide a blade assembly as aforesaid which reduces binding and hence requires less force to slice the potato into strips.

Yet another object of the present invention is to provide a self-centering blade assembly which, during slicing, keeps the potatoes centered and reduces the tendency of the potatoes to turn or tumble.

Still another object of the present invention is to provide a blade assembly having longer lasting knife blades.

Other objects of the present invention will be apparent from the drawings and following detailed description.

SUMMARY OF THE INVENTION

In accordance with the foregoing objects, the present invention comprises a slicing apparatus for slicing potatoes and other food products into strips. It includes two sets of cutting elements, each having a first edge of chevron configuration and edge portions converging to an apex, and a second sharpened edge of chevron configuration opposite said first edge. It further includes cutting element mounting means for mounting the first and second set of cutting elements in a substantially pyramidal configuration such that (1) the cutting elements of the first set are substantially parallel to one another; (2) the cutting elements of the second set are substantially parallel to one another and substantially perpendicular to the first set; and (3) the apexes of both the first and second sets of cutting elements point substantially downstream. Further, the first and second sets of cutting elements are mounted in transversely spaced, axially staggered pairs such that each successive downstream pair of cutting elements is disposed incrementally closer to the axial centerline of the apparatus. Each pair of cutting elements stops short of axially overlapping any adjacent downstream pair.

BRIEF DESCRIPTION OF THE DRAWINGS

In the drawings:

FIG. 1 is a perspective view of an apparatus for slicing potatoes and other food products in accordance with the present invention.

FIG. 2 is an elevational view of one of the blades of the apparatus of FIG. 1.

FIG. 3 is a vertical sectional view taken along line 3—3 of FIG. 1.

FIG. 6 is a schematic view illustrating a few of the blades slicing through a potato.

DETAILED DESCRIPTION OF A PREFERRED EMBODIMENT

Figure 4:
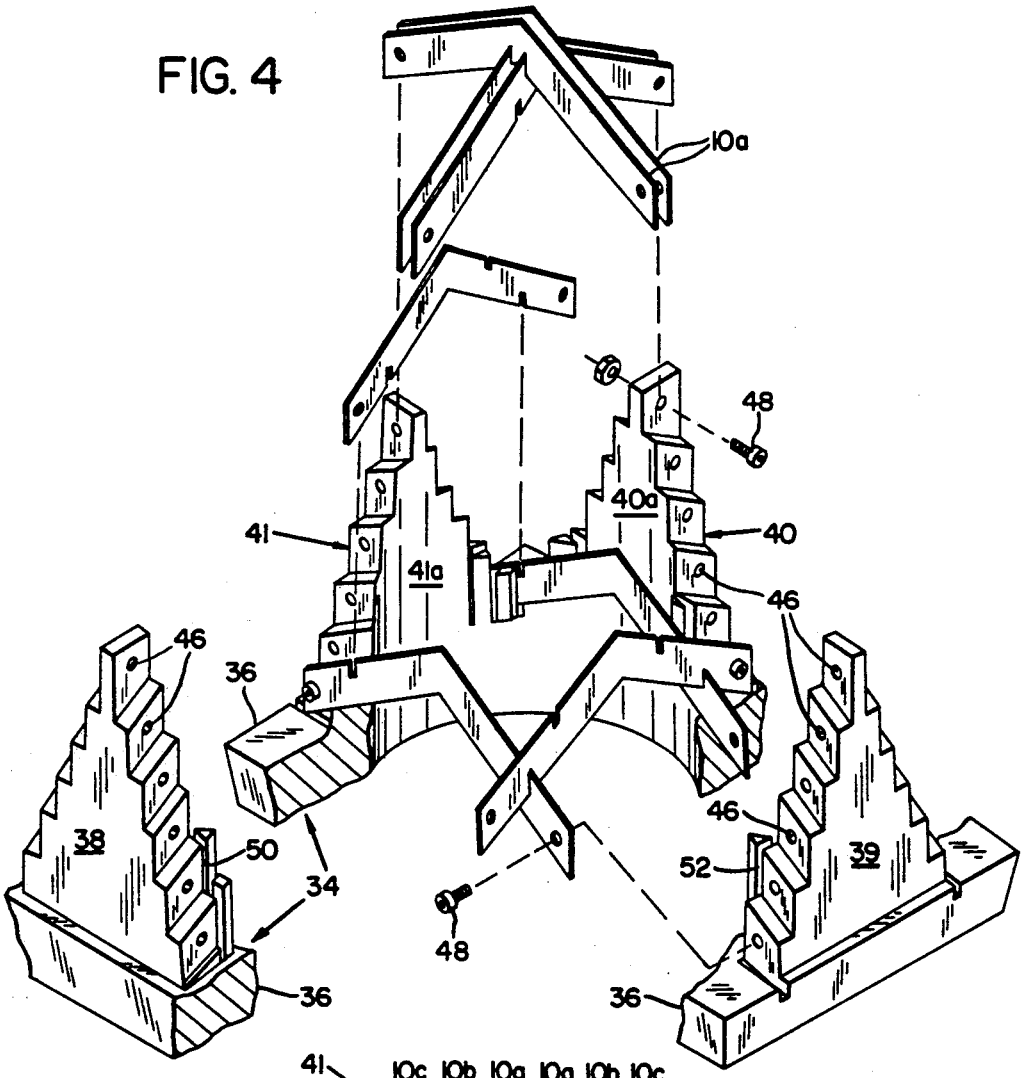
FIG. 4 is an exploded, perspective view with some of the knife blades omitted.

The present invention is an improved blade assembly ideally suited for use in hydraulic flow type potato slicing systems. In such systems, potatoes are carried by a flowing fluid carrier to a cutting zone where the blade assembly is located in line with the flow path of the potatoes. The potatoes are forced through the blade assembly by the hydraulic flow and their own momentum, and thereby sliced into strips. For reference purposes, the potatoes enter a pipe or conduit upstream of the blade assembly and are carried downstream by the hydraulic flow to the blade assembly.

As shown in FIG. 1, the blade assembly or matrix includes a plurality of perpendicularly intersecting cutting elements or knife blades 10 of chevron configuration and cutting element mounting means for mounting the knife blades in a nested, substantially pyramidal arrangement. As explained further below, each blade can be viewed as part of a pair of blades which are parallel to and transversely spaced from one another as, for example, blade pairs 10*a*, 10*b*, 10*c* (FIG. 3). Though not apparent from FIG. 1, when the blade assembly is coupled to the pipe or conduit through which the potatoes are individually and sequentially fed, the apex of the pyramid points downstream. For reference purposes, the blade assembly has an axial centerline A (FIG. 1).

Referring to FIG. 2, each knife blade 10 has a trailing chevron edge 14 which includes an apex 18. The knife blade also includes a leading, sharpened chevron edge 22 opposite edge 14. Sharpened edge 22 preferably defines an angle of 120°, such that the two converging portions defining edge 22 are disposed at an angle of 60° relative to the direction of approach of the potatoes.

Each blade 10 is provided with slots 26 to partially intersect other perpendicular blades in the blade matrix. The number and orientation of the slots in each knife blade depend upon the blade's position in the blade arrangement. For example, blades 10*a* at the apex of the pyramid each have two closely spaced slots in edge 22. An opening 30 is provided at each end of the blade to facilitate its mounting to the mounting means. It has been found that the slicing action of the blade through the potato works best when the blade thickness is about 0.04 inch and edge 22 is hollow ground.

Figure 5:
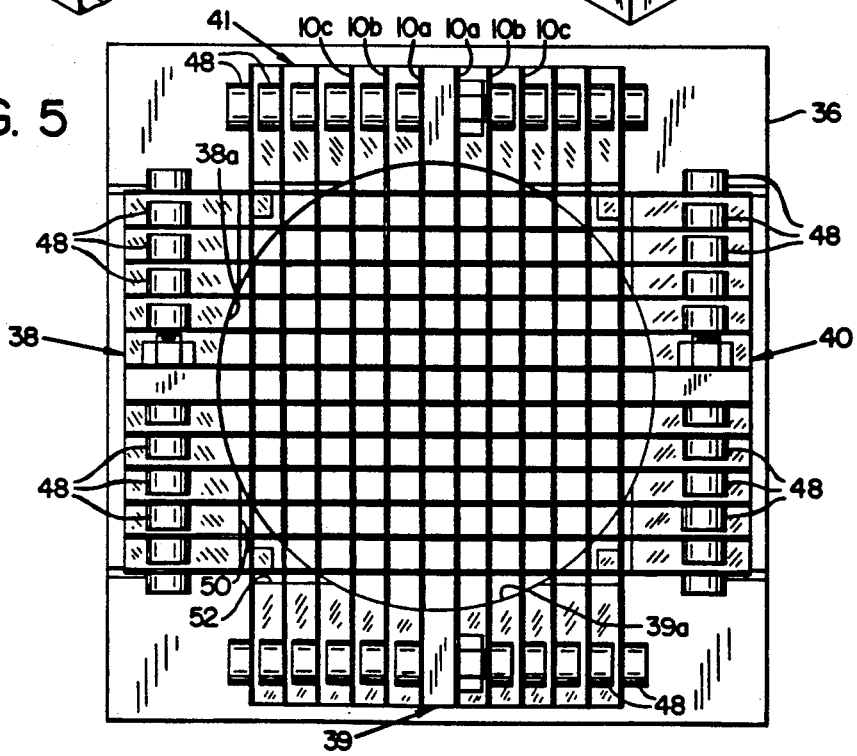
FIG. 5 is a top plan view of the apparatus.

The cutting element mounting means to which the knife blades are mounted includes a unitary fixture 34 having a base 36 and two pairs of diametrically opposed support portions 38, 39, 40, 41 (FIG. 4). The support portions each have opposed, stepped sides for mounting the ends of the knife blades in an axially staggered arrangement, and a cylindrically curved inner wall portion 38*a* (FIG. 3), 39*a* (FIG. 5), 40*a* (FIG. 4) or 41*a* (FIG. 4). Wall portions 38*a*, 39*a*, 40*a* and 41*a* together define a continuous cylindrical bore. The stepped sides of each support portions 38, 39, 40, 41 are inclined in the downstream direction to correspond to the shape of the knife blade ends. They are also provided with threaded openings 46 (FIG. 4) corresponding to openings 30 of the knife blade to facilitate the mounting of the knife blades thereto by suitable fastening means, such as allen screws 48 (FIG. 1) or the like.

Because of the fixture's cylindrical bore, support portions 38, 39, 40, 41 are slotted, as at 50, 52 (for example), to accommodate the ends of a few of the upstream blades. Blade supporting fixture 34 mounts the blades in two sets of parallel blades, with one set of blades being perpendicular to the other set. As shown best in FIG. 3, each set of parallel blades is arranged in transversely spaced, axially staggered pairs. The blades of each pair are spaced equidistant from and on opposite sides of centerline A. In each set of parallel blades, the blades of the farthest upstream pair are spaced farthest apart and hence farthest from centerline A, with each successive downstream blade pairs being located incrementally closer to centerline A. As shown in FIG. 3, for example, blades 10*a*, which are located at the apex of the pyramid and farthest downstream of the blades parallel thereto, are spaced closest together and hence closest to centerline A. The next successive downstream blades 10*b* are transversely spaced an incrementally greater amount.

The blades are arranged in a very tight, nested arrangement, and yet in a manner such that each pair of transversely spaced blades does not overlap axially with any parallel blade pairs, regardless of whether such blade pairs are upstream or downstream thereof. In this way, as the blades progressively slice away outermost sections of the potato, no such incised sections are engaged on opposite transverse side portions thereof by parallel knife blades (except for the single, centermost strip sliced by the apex of the pyramidal formation). As illustrated by FIG. 3 and particularly FIG. 6, binding of the incised portions of potato P due to "pinching" or compression of such portion between parallel blades is essentially eliminated because no two pairs of axially staggered, parallel blades axially overlap. Each incised potato portion, when subject to an outwardly transverse force by the adjacent blade slicing therethrough, is free to lean away from the blade to minimize resistance. Only the single, centermost strip sliced by the apex of the pyramidal formation is not free to do so. Thus, virtually all incised portions are frictionally engaged on, at most, two perpendicular sides. Such portions are never frictionally engaged on three or even four sides, as where portions of two parallel, closely spaced blades axially overlap.

The angled cutting edge of the blade enables the blade to slice more easily through the potato, thereby reducing feathering. Furthermore, the pyramidal arrangement of the blades, in which each blade converges in the direction of travel of the potato, and the cylindrical bore of the blade supporting fixture serves to center the potato and guide it along centerline A. This inhibits any tendency of the potato to turn or tumble as it encounters the blade assembly and promotes a clean, smooth and efficient slicing action of the blades through the potato. This is particularly important in hydraulic slicing systems since the potatoes are not always perfectly centered in the fluid flow, and aligning mechanisms just upstream of the blade assembly do not always completely correct the problem.

Because of the reduced binding and centering features of the present invention, the force required to slice the potato into strips is minimized. Thus, the magnitude of the velocity (and hence momentum) of the potato required to overcome the resistance of the blades can also be reduced, thereby lessening the force of impact of the potato against the blades so as to further reduce feathering. The reduced feathering means that the potato strips are less fragile and prone to breakage during subsequent processing and handling. Finally, the present invention promotes longer lasting knife blades, and reduces down time caused by potatoes becoming wedged or plugged within the blade assembly.

It will be apparent that the present invention can be used with other than hydraulic type slicing systems, including systems in which the potato is held stationary. Also, the invention may be suited for slicing vegetables and other food products besides potatoes.

Having illustrated and described the principles involved in this invention by which presently preferred embodiment and several suggested alternatives, it should be apparent to those persons skilled in the art that such embodiments may be modified in arrangement and detail without departing from such principles. We claim as our invention all such modifications as come within the true spirit and scope of the invention as defined by the following claims.

I claim:

1. A food slicing apparatus for slicing vegetables into strips, comprising:

a first set of cutting elements, each having a first edge of chevron configuration and an apex, and a second sharpened edge of chevron configuration opposite said first edge;

a second set of cutting elements, each having a first edge of chevron configuration and an apex, and a second sharpened edge of chevron configuration opposite said first edge of said second set for slicing vegetables;

the cutting elements each having two angled blade segments with knife edges thereon meeting at a downstream knife edge convergence;

cutting element mounting means for mounting said first and second set of cutting elements in a substantially pyramidal configuration such that (1) said cutting elements of said first set are substantially parallel to one another, and (2) said cutting elements of said second set are substantially parallel to one another and substantially perpendicular to said first set of cutting elements, the pyramidal configuration having an apex at a downstream end thereof;

said cutting element mounting means further mounting both said cutting elements of said first and second sets in axially staggered, transversely spaced pairs such that each successive downstream pair of cutting elements is disposed incrementally closer to the axial centerline of the apparatus.

2. An apparatus according to claim 1 including fastening means for removably fastening said first and second sets of cutting element to said mounting means, said fastening means including a plurality of fasteners, said mounting means including a plurality of support surfaces, each said cutting element being fastened against at least one of said support surfaces by at least one of said fasteners, said one fastener being disposed substantially transversely to said cutting element.

3. An apparatus according to claim 1 wherein said pairs of parallel cutting elements, when viewed from the side, are arranged in nested relationship but without axially overlapping one another.

4. An apparatus according to claim 1 wherein said cutting element mounting means includes a unitary fixture having a plurality of stepped support portions for mounting ends of the cutting elements and an inner wall defining a substantially cylindrical bore.

5. An apparatus according to claim 1 wherein said mounting means includes a first pair of opposed support portions for mounting opposite ends of first set of cutting elements, and a second pair of opposed support portions for mounting opposite ends of said second set of cutting elements.

6. A food slicing apparatus for slicing vegetables into strips, comprising:

a first set of cutting elements, each having a first edge of chevron configuration and an apex, and a second sharpened edge of chevron configuration opposite said first edge;

a second set of cutting elements, each having a first edge of chevron configuration and an apex, and a second sharpened edge of chevron configuration opposite said first edge of said second set for slicing vegetables;

cutting element mounting means for mounting said first and second set of cutting elements in a substantially pyramidal configuration such that (1) said cutting elements of said first set are substantially parallel to one another, and (2) said cutting elements of said second set are substantially parallel to one another and substantially perpendicular to said first set of cutting elements, the pyramidal configuration having an apex at a downstream end thereof;

said cutting element mounting means further mounting both said cutting elements of said first and second sets in axially staggered, transversely spaced pairs such that each successive downstream pair of cutting elements is disposed incrementally closer to the axial centerline of the apparatus;

said mounting means including a first pair of opposed support portions for mounting opposite ends of said first set of cutting elements, and a second pair of opposed support portions for mounting opposite ends of said second set of cutting elements;

each said first and second support portions having respective inner wall portions which together define a continuous cylindrical bore wall, and opposed side walls having steps formed therein.

7. An apparatus according to claim 6 wherein each said step is inclined at an acute angle with respect to said cylindrical bore wall.

8. An apparatus according to claim 7 wherein each said second edge of said cutting elements define an angle of substantially 120°.

9. In a system for slicing food products, including potatoes, into strips in which the food products are carried individually and sequentially by a hydraulic stream through a cutting zone, an improved knife assembly located in the cutting zone comprising:

a plurality of thin, intersecting cutting elements of chevron configuration, each having a first edge forming an apex thereof and an opposite second cutting edge;

the cutting elements each having two angled blade segments with said first and second edges thereon meeting at a downstream knife edge convergence;

cutting element mounting means for mounting said cutting elements in a nested, substantially pyramidal matrix such that (1) said cutting edge of each said cutting element is the furthest upstream portion thereof, and (2) the apex of each said cutting element points substantially downstream;

said mounting means mounting said cutting elements in a first series of parallel cutting elements and a second series of parallel cutting elements which are substantially perpendicular to and intersect said first series of cutting elements, said cutting elements of each said first and second series being mounted in axially staggered pairs, the outermost pairs being disposed furthest upstream, with each successive downstream pair being disposed incrementally closer to an axial centerline of said assembly, said first and second edges of each said pair of cutting elements terminating short of any adjacent upstream or downstream cutting elements parallel thereto.

10. A slicing apparatus for slicing food products, including potatoes, fed individually and sequentially in a fluid stream thereto, comprising:

a plurality of chevron cutting elements, each having a first edge defining an apex thereof and an opposite second cutting edge, the cutting elements each having two angled blade segments with said first and second edges thereon meeting at a downstream knife edge convergence, cutting element mounting means for mounting said cutting elements in a substantially pyramidal matrix, and having an inner bore wall defining a substantially cylindrical passage, said cutting elements including a first set of cutting elements parallel to a first imaginary reference plane bifurcating said passage and a second set of cutting elements parallel to a second imaginary reference plane bifurcating said passage, said first and second reference planes intersecting at a substantially right angle at an axial centerline of said passage, said first reference plane intersecting the respective apexes of said second set of cutting elements, said second reference plane intersecting the respective apexes of said first set of cutting elements, said mounting means mounting said first set of cutting elements in axially staggered, transversely spaced pairs such that said cutting elements of each pair are disposed on opposite sides and equidistant from said first reference plane, said pairs of cutting elements of said first set converging incrementally toward said first reference plane with each successive downstream pair, said mounting means mounting said second set of cutting elements in axially staggered, transversely spaced pairs such that said cutting elements of each pair are disposed on opposite sides and equidistant from said second reference plane, said pairs of cutting elements of said second set converging incrementally toward said second reference plane with each successive downstream pair.

11. An apparatus for strip cutting of potatoes by hydraulically passing said potatoes through a knife device, said knife device comprising a mounting framework having stepped mounting locations thereon and a plurality of chevron-shaped knife elements mounted upon said framework at said stepped mounting locations and positioned in a rectangular grid array, each knife elements extending substantially transverse to the direction of flow in said apparatus and having two angles blade segments with knife edges thereon meeting at a downstream knife edge convergence whereby a slicing action on the potatoes occurs, and, fastener means to rigidly attach each knife element into said framework at said stepped mounting locations, said grid array arranged in a stepwise pyramidal fashion with each successive knife element being staggered inwardly and downstream of its outwardly adjacent knife element whereby successive blades is said array sequentially cut said potatoes from the periphery to the inner portions thereof into elongated strips.

* * * * *

UNITED STATES PATENT AND TRADEMARK OFFICE

CERTIFICATE OF CORRECTION

PATENT NO. : 5,009,141

DATED : April 23, 1991

INVENTOR(S) : John C. Julian et al.

It is certified that error appears in the above-identified patent and that said Letters Patent is hereby corrected as shown below:

On the title page, item [75]:

Add the following inventor: --Camilo Carvalho, Auburn, Washington--.

Claim 11, column 8, lines 35-36, "elements" should read --element--.

Claim 11, column 8, line 37, "angles" should read --angled--.

Claim 11, column 8, line 46, "is" should read --in--.

Signed and Sealed this

Seventeenth Day of September, 1991

*Attest:*

*Attesting Officer*

HARRY F. MANBECK, JR.

*Commissioner of Patents and Trademarks*